US012467259B2

(12) United States Patent
Clark

(10) Patent No.: US 12,467,259 B2
(45) Date of Patent: Nov. 11, 2025

(54) METHOD OF MANUFACTURING A DOME AND A DOME MANUFACTURED USING THE METHOD

(71) Applicant: Rolls-Royce SMR Limited, Derby (GB)

(72) Inventor: Daniel Clark, Derby (GB)

(73) Assignee: ROLLS-ROYCE SMR LIMITED, Derby (GB)

( * ) Notice: Subject to any disclaimer, the term of this patent is extended or adjusted under 35 U.S.C. 154(b) by 272 days.

(21) Appl. No.: 18/253,078

(22) PCT Filed: Oct. 28, 2021

(86) PCT No.: PCT/EP2021/079907
§ 371 (c)(1),
(2) Date: May 16, 2023

(87) PCT Pub. No.: WO2022/106171
PCT Pub. Date: May 27, 2022

(65) Prior Publication Data

US 2024/0011293 A1 Jan. 11, 2024

(30) Foreign Application Priority Data

Nov. 19, 2020 (GB) ..... 2018183

(51) Int. Cl.
*E04C 3/04* (2006.01)

(52) U.S. Cl.
CPC ..... *E04C 3/04* (2013.01); *E04C 2003/0413* (2013.01); *E04C 2003/046* (2013.01)

(58) Field of Classification Search
CPC ..... E04C 3/04; E04C 2003/0413; E04C 2003/046; E04C 2003/0452; E04C 3/06;
(Continued)

(56) References Cited

U.S. PATENT DOCUMENTS 523,425 A * 7/1894 Cornell ..... E04C 3/04 211/183
1,193,542 A * 8/1916 Gregory ..... E04B 1/19 52/576

(Continued)

FOREIGN PATENT DOCUMENTS

CN 104763050 B 7/2015
DE 210943 A1 6/1984

(Continued)

OTHER PUBLICATIONS

UKIPO Search Report, Application No. GB-2018183.0, dated May 7, 2021, 2 pages.

(Continued)

*Primary Examiner* — Rodney Mintz
(74) *Attorney, Agent, or Firm* — Quarles & Brady LLP

(57) ABSTRACT

There is described a method of manufacturing a dome (2), the method comprising: providing a plurality of beams (6, 106, 206, 306), each of the plurality of beams (6, 106, 206, 306) comprising one or more slots (16, 22); and engaging at least one of the slots (16, 22) of each of the plurality of beams (6, 106, 206, 306) with a slot (16, 22) of the one or more slots (16, 22) of another of the plurality of beams (6, 106, 206, 306) so as to form at least part of the dome (2). There is also described a dome (2) manufactured in accordance with the method.

10 Claims, 14 Drawing Sheets

(58) Field of Classification Search
CPC ..... E04B 7/105; E04B 1/3211; E04B 2001/3241; E04B 1/19; E04B 1/58; E04H 5/02
See application file for complete search history.

(56) References Cited

U.S. PATENT DOCUMENTS

| | | | | | |
|---|---|---|---|---|---|
| 1,545,168 | A | | 7/1925 | Schenck | |
| 3,378,984 | A | * | 4/1968 | Quisling | E04C 5/065 52/842 |
| 3,389,451 | A | * | 6/1968 | Speca | B21D 39/038 493/391 |
| 3,413,774 | A | * | 12/1968 | Oberreich | B27H 1/00 144/270 |
| 3,462,893 | A | * | 8/1969 | Ewald | E04B 7/105 D25/13 |
| 3,626,647 | A | * | 12/1971 | Guzelimian | E04B 7/102 52/80.2 |
| 4,945,705 | A | * | 8/1990 | Rump | B66C 6/00 52/843 |
| 5,524,410 | A | * | 6/1996 | Menchetti | E04C 3/086 52/635 |
| 5,661,881 | A | * | 9/1997 | Menchetti | E04C 3/086 29/6.1 |
| 5,899,041 | A | * | 5/1999 | Durin | H02G 3/263 52/662 |
| 6,748,712 | B2 | * | 6/2004 | Likozar | E04B 9/14 52/81.3 |
| 6,976,343 | B2 | * | 12/2005 | McGushion | E04C 3/07 52/840 |
| 8,307,605 | B2 | * | 11/2012 | McCarty | E04B 7/105 52/80.1 |
| 9,151,306 | B2 | * | 10/2015 | Sun | F16B 5/0004 |
| 9,957,031 | B2 | * | 5/2018 | Golshany | B64C 1/08 |
| 2003/0230043 | A1 | | 12/2003 | Likozar | |
| 2005/0210819 | A1 | * | 9/2005 | McGushion | E04C 3/07 52/837 |
| 2008/0236057 | A1 | * | 10/2008 | McCarty | E04B 7/08 52/80.1 |
| 2014/0305047 | A1 | | 10/2014 | Sun | |
| 2017/0058506 | A1 | | 3/2017 | Golshany et al. | |
| 2023/0398642 | A1 | * | 12/2023 | Clark | E04H 5/02 |

FOREIGN PATENT DOCUMENTS

| | | | | | |
|---|---|---|---|---|---|
| FR | 2247938 | A5 | * | 5/1975 | |
| FR | 2591634 | A1 | | 6/1987 | |
| JP | 2013253870 | A | * | 12/2013 | |
| KR | 101209662 | B | | 10/2011 | |
| KR | 20150088049 | A | | 7/2015 | |
| KR | 20180120557 | A | * | 11/2018 | E04B 1/19 |

OTHER PUBLICATIONS

International Search Report and Written Opinion, International Application No. PCT/EP2021/079907, European Patent Office—Searching Authority, mailed Apr. 2, 2022, 10 pages.
Japanese Office Action, corresponding to JP 2023-530285, dated Aug. 19, 2025.

* cited by examiner

METHOD OF MANUFACTURING A DOME AND A DOME MANUFACTURED USING THE METHOD

RELATED APPLICATIONS

This application is a 35 U.S.C. § 371 national phase application of PCT/EP2021/079907 (WO-2022/106170 A1), filed on Oct. 28, 2021, entitled "A METHOD OF MANUFACTURING A DOME AND A DOME MANUFACTURED USING THE METHOD", and claims priority to GB-2018183.0 filed on Nov. 19, 2020, which is incorporated herein by reference in its entirety.

FIELD OF THE DISCLOSURE

The disclosure relates to a method of manufacturing a dome and a dome manufactured using the method.

BACKGROUND

Power stations commonly comprise reactors housed within domed containment vessels. The containment vessel is designed to contain toxic material released by the reactor in the event of the reactor malfunctioning. Domed vessels are typically forged or fabricated from forged petals off-site before being craned into position. Such a process is typically time-consuming and expensive, requires a significant amount of space on site and requires good weather conditions for assembly.

It is therefore desirable to provide an improved method of manufacturing a dome and a dome manufactured using the method.

SUMMARY OF THE DISCLOSURE

According to a first aspect, there is provided a method of manufacturing a dome, the method comprising: providing a plurality of beams, each of the plurality of beams comprising one or more slots; and engaging at least one of the slots of each of the plurality of beams with a slot of the one or more slots of another of the plurality of beams so as to form at least part of the dome.

At least a portion of each of the plurality of beams may be a T-beam comprising a web and a flange.

The one or more slots may be formed by the webs.

The one or more slots may be angled non-perpendicularly from the edges of the webs.

The flange may be curved about its longitudinal axis toward the web.

The flange may be curved along its longitudinal axis toward the web.

An edge of the web opposing the flange may be curved along its longitudinal axis toward or away from the flange.

The curvature of the edge of the web may be created by weld build up, upsetting or rolling.

Each beam may be manufactured by welding the web to the flange. Cooling of the weld may induce the curvature in the web and/or the flange.

At least one of the webs may comprise a plurality of web sections. Each web section may be separated from its adjacent web section by a gap.

At least one of the flanges may comprise a plurality of flange sections each separated by a gap. Each of the plurality of beams may comprise a further flange disposed on an opposing side of the web to the flange. The further flange may comprise a plurality of further flange sections each separated by a gap.

The one or more slots may be formed in opposing sides of the webs.

One or more of the webs and/or flanges may comprise one or more through holes.

One or more plates may be welded to the webs of the plurality of beams so as to form an exterior skin of the dome.

One or more plates may be welded to the webs of the plurality of beams so as to form an interior skin of the dome.

One or more voids may be formed between the exterior skin and the interior skin. One or more of the voids may be filled with a solid mass.

A lower portion of the dome may comprise a hollow cylindrical structure formed by a plurality of blocks or plates.

At least some of the plurality of beams may be arranged in a triangular lattice so as to form at least part of a geodesic dome.

At least some of the plurality of beams may be arranged in a rectangular lattice.

At least some of the plurality of beams may be arranged in a hexagonal lattice.

According to a second aspect, a dome manufactured in accordance with any preceding statement is provided.

BRIEF DESCRIPTION OF THE DRAWINGS

Arrangements will now be described, by way of example, with reference to the accompanying drawings, in which.

DETAILED DESCRIPTION

Figure 1:
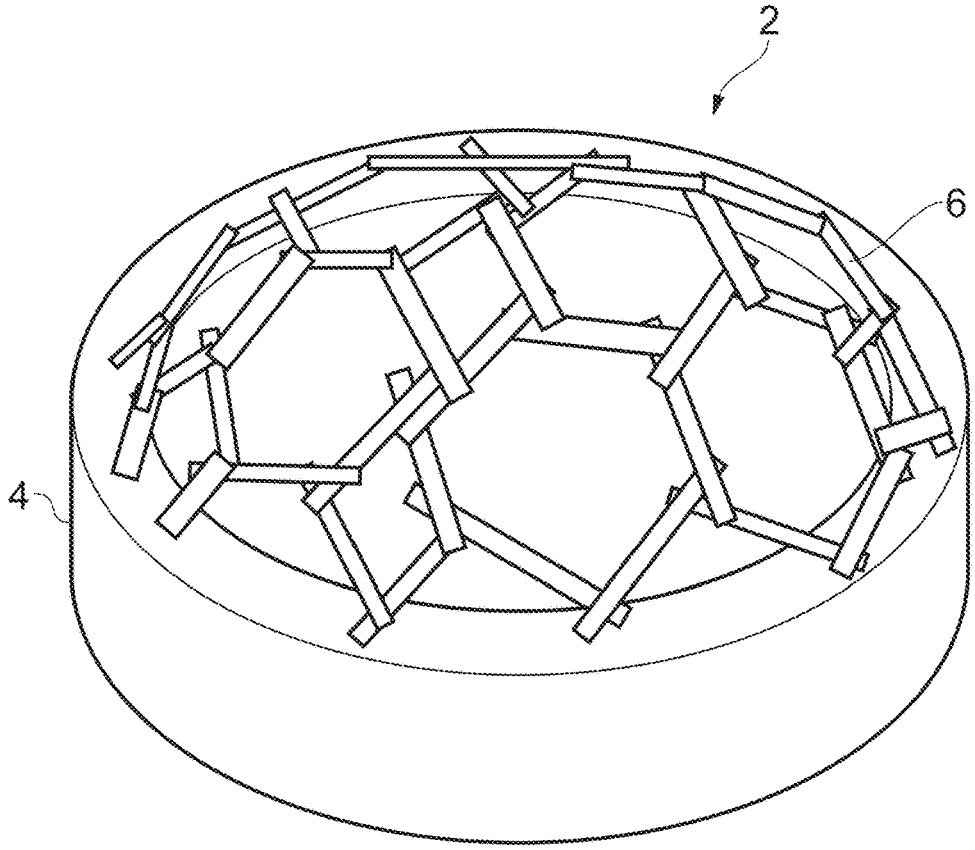
FIG. 1 is a perspective view of a dome.

FIG. 1 shows a dome 2 for a power station reactor. A lower portion of the dome 2 is formed by a plurality of blocks or plates arranged in the shape of a hollow cylindrical structure 4. The hollow cylindrical structure 4 may taper inwardly in an upward direction. An upper portion of the dome 2 is formed by a plurality of beams 6 which are joined together so as to form a hemispherical frame.

Figure 2:
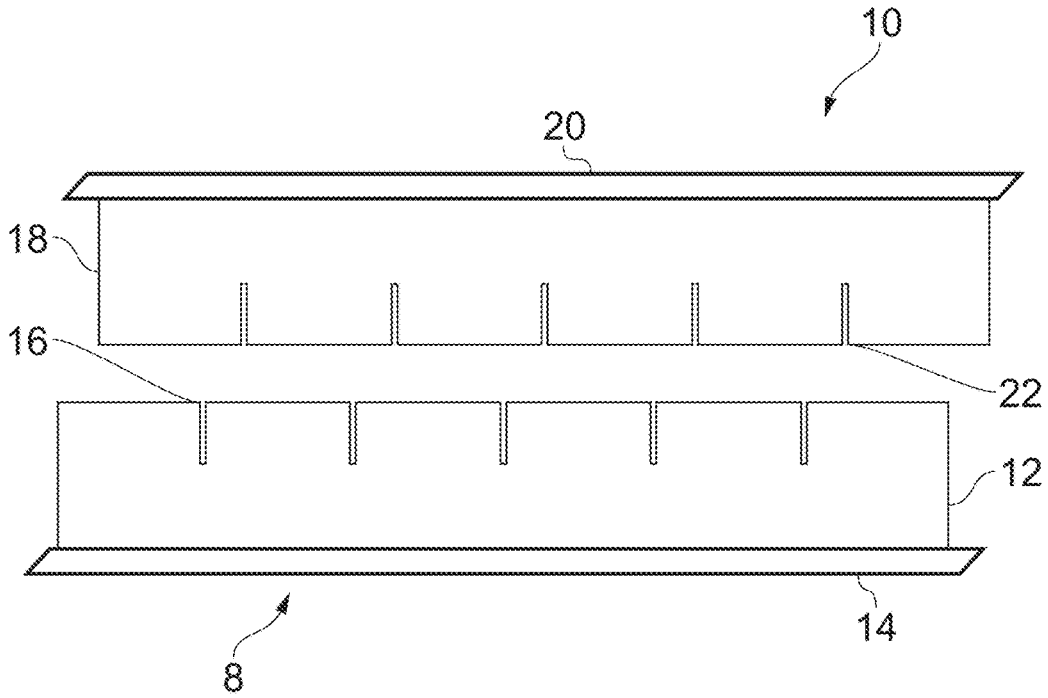
FIG. 2 is a perspective view of a first beam and a second beam.

FIG. 2 shows a first beam 8 and a second beam 10 of the plurality of beams 6. The first beam 8 is a T-beam and comprises a web 12 and a flange 14. A series of slots 16 are formed in the web 12 that extend perpendicularly from an outer edge of the web 12. The second beam 10 is also a T-beam and also comprises a web 18 and a flange 20. A series of slots 22 are formed in the web 18 that extend perpendicularly from an outer edge of the web 18. The slots 16 of the first beam 8 and the slots of the second beam 10 are the same length and extend approximately half the distance from the edges of the webs 12, 18 to the flanges 14, 20. In alternative arrangements, the slots 16, 22 may be angled non-perpendicularly from the outer edges of the webs 12, 18.

Figure 3:
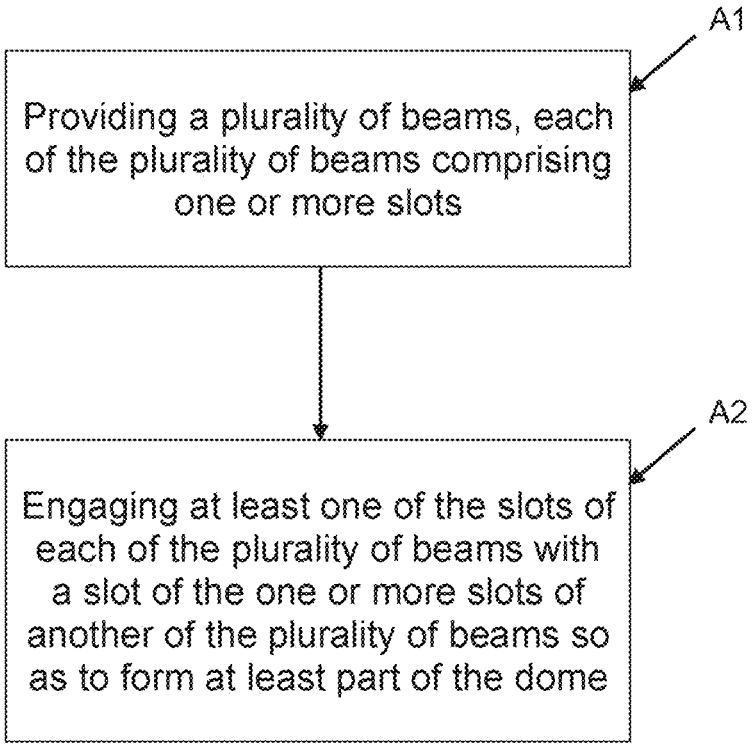
FIG. 3 shows a flowchart of a method of manufacturing the dome.

FIG. 3 is a flowchart of a method of manufacturing the dome 2. In a step A1 of the method, a plurality of the beams 6 are provided. In a step A2 of the method, at least one of the slots 16, 22 of each of the plurality of beams 6 are engaged with a slot 16, 22 of the one or more slots 16, 22 of another of the plurality of beams 6 so as to form the upper part of the dome 2.

Figure 4:
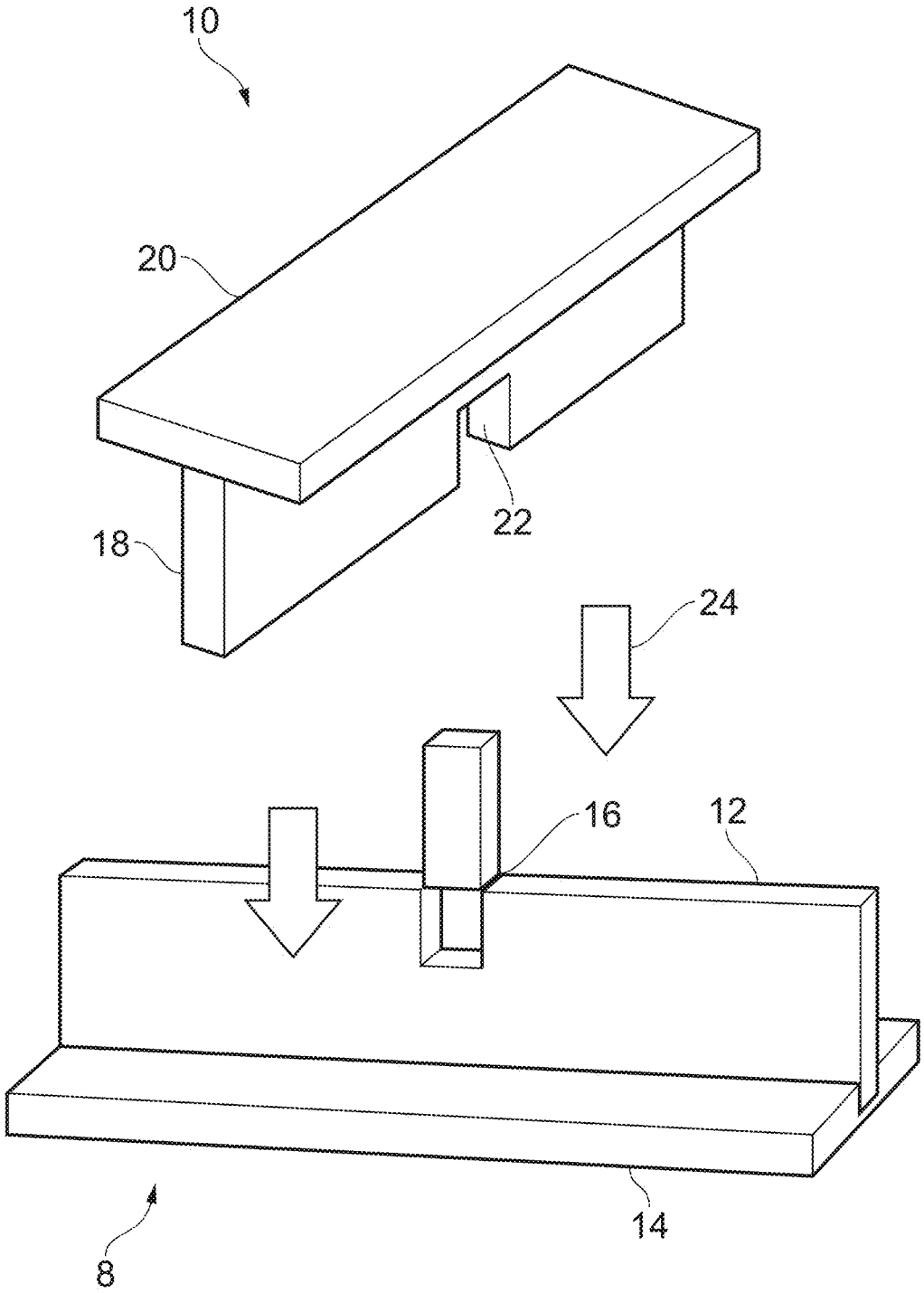
FIG. 4 is a close-up perspective view of portions of the first beam and the second beam.

FIG. 4 shows a portion of one of the first beams 8 and a portion of one of the second beams 10 after step A1 has taken place and before the step A2 has taken place. Only a portion of the first and second beams 8, 10 are shown, for clarity. The first beam 8 and the second beam 10 are arranged orthogonally with respect to each other and such that their slots 16, 22 are aligned. In step A2, the second beam 10 is moved relative to the first beam 8 in the direction denoted by arrow 24. Alternatively, the first beam 8 may move in the opposite direction toward the second beam 10. The beams 6 (e.g. the first and second beams 8, 10) may be positioned using a winch and a crane.

Figure 5:
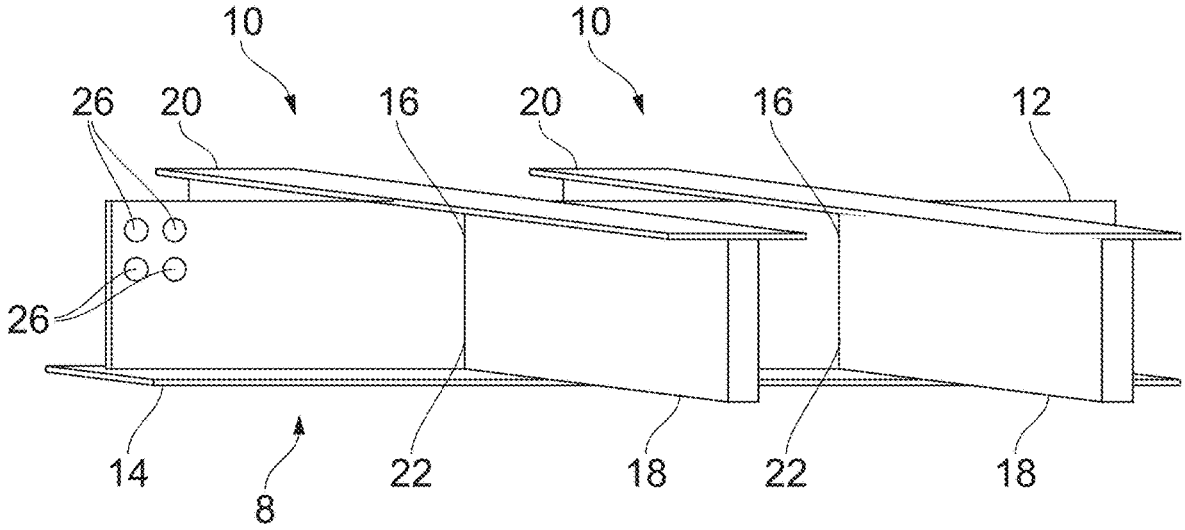
FIG. 5 is a close-up perspective view of portions of the first and second beam connected together.

FIG. 5 shows a portion of the first beams 8 and a portion of two of the second beams 10 after steps A1 and A2 have taken place. A larger portion of the first beam 8 is shown in FIG. 5 than is shown in FIG. 4. In the arrangement shown in FIG. 5, a first slot 16 of the first beam 8 is engaged with a slot 22 of the left-hand side second beam 10 and a second slot 16 of the first beam 8 is engaged with a slot 22 of the right-hand side second beam 10. Although not shown, the beams 6 may be pinned together at their respective joints. Alternatively, the beams 6 may be bolted or welded together. Alternatively, the beams 6 may be precision cut with a close fit such that additional joining processes are not required.

The web 12 is provided with a plurality of through holes 26. The through holes 26 can act as a passageway through which utilities such as wires, power cables, optical cables, sensors or pipes may pass or through which inspection may be carried out.

Additionally or alternatively, the through holes 26 may be used as connection or anchoring points to aid in the assembly process.

Figure 6:
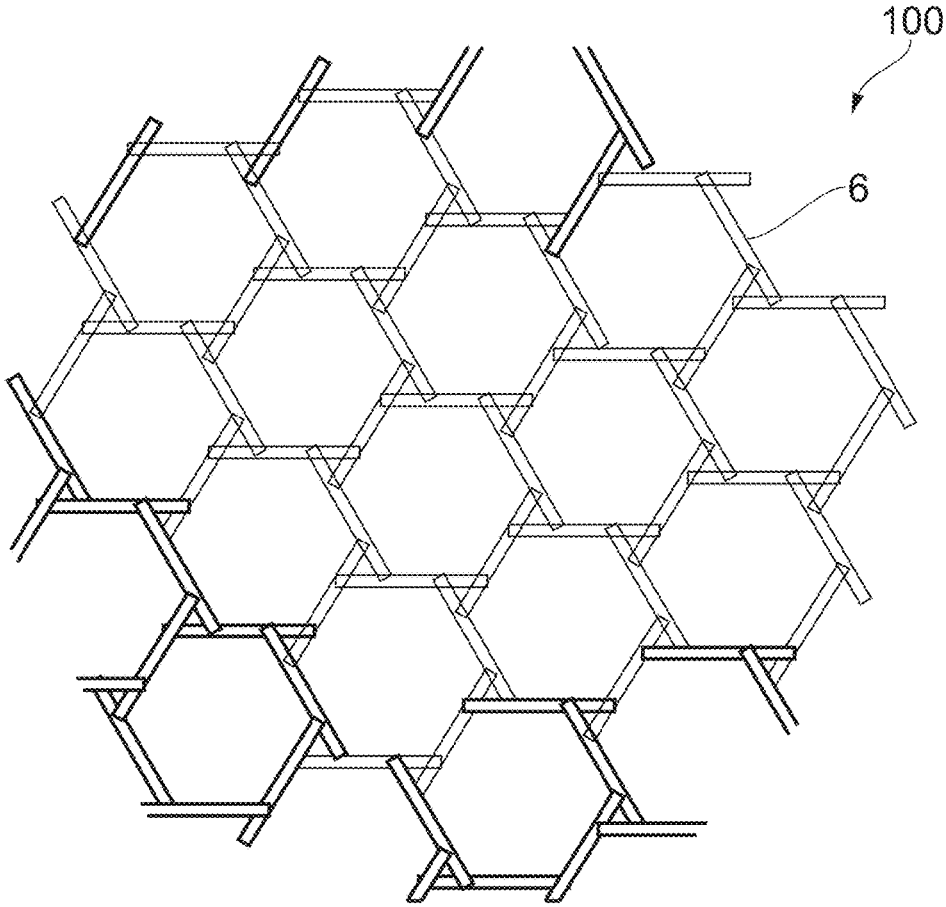
FIG. 6 is a plan view of a hexagonal lattice arrangement.

Multiple connections between multiple beams 6 may be made through the engagement of multiple slots 16, 22 so as to manufacture an upper part of a dome 2 such as that shown in FIG. 1. FIG. 6 shows a plan view of such a structure. The beams 6 are arranged so as to form a hexagonal lattice arrangement 100.

Figure 7:
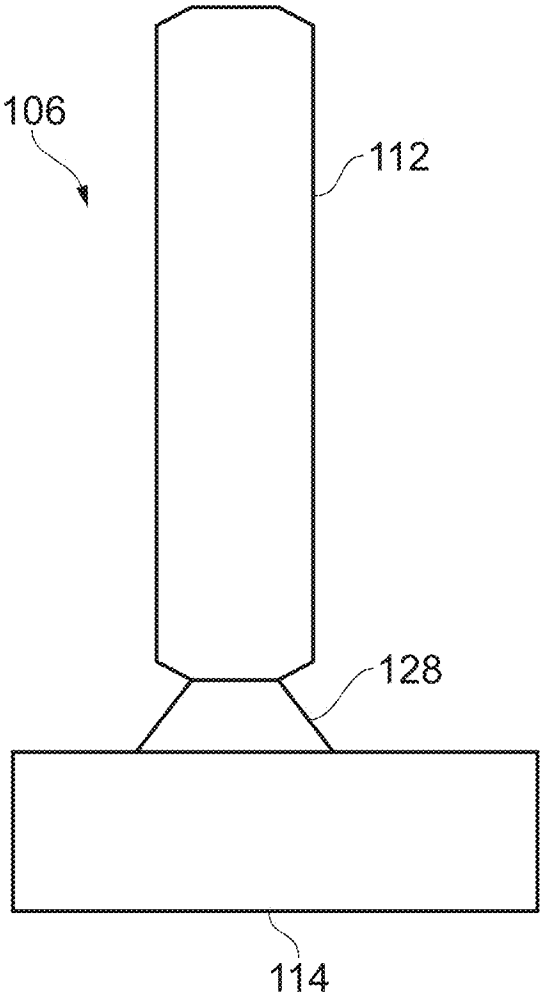
FIG. 7 is a first cross-sectional view of a first alternative beam.

FIG. 7 shows a first cross-sectional view of a first alternative beam 106 part way through manufacture. The first alternative beam 106 generally corresponds to the beams 6 described previously (i.e. the first beam 8 and the second beam 10) and features thereof are denoted using the same reference numerals with the addition of a value of 100. However, prior to attachment of the web 112 to the flange 114, a stub 128 is added to the flange 114 by building up weld metal. The stub 128 extends along the longitudinal length of the flange 114.

Figure 8:
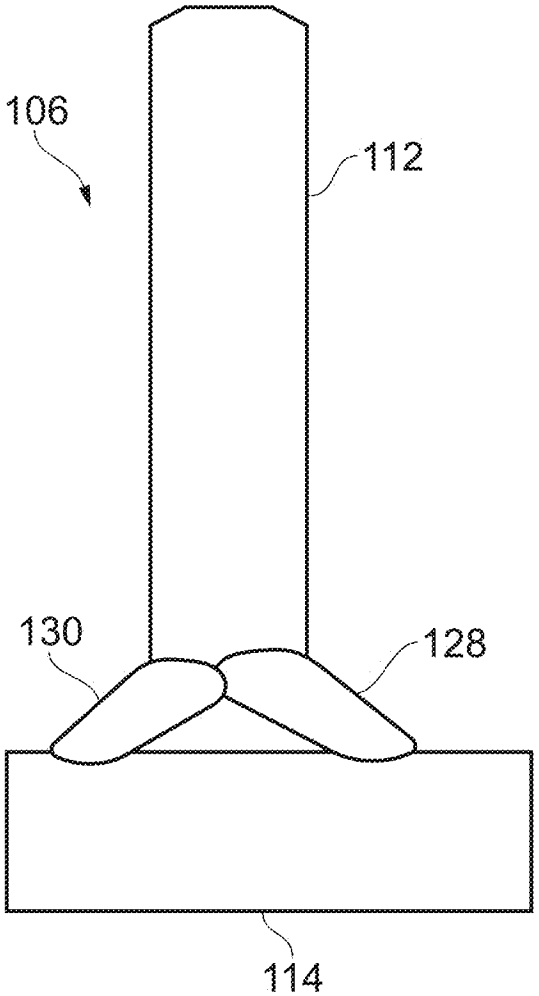
FIG. 8 is a second cross-sectional view of the first alternative beam.

FIG. 8 shows a further process in the method of manufacturing the first alternative beam 106 in cross-section. The first alternative beam 106 is shown prior to cooling. As shown, additional weld material 130 is used to bond the flange 114 and the stub 128 to the web 112. The provision of a stub 128 improves access for the final welding process between the web 112 and the flange 114. It also generates welding distortion, which can be used to generate a desired curvature of the web 112 and the flange 114.

Figure 9:
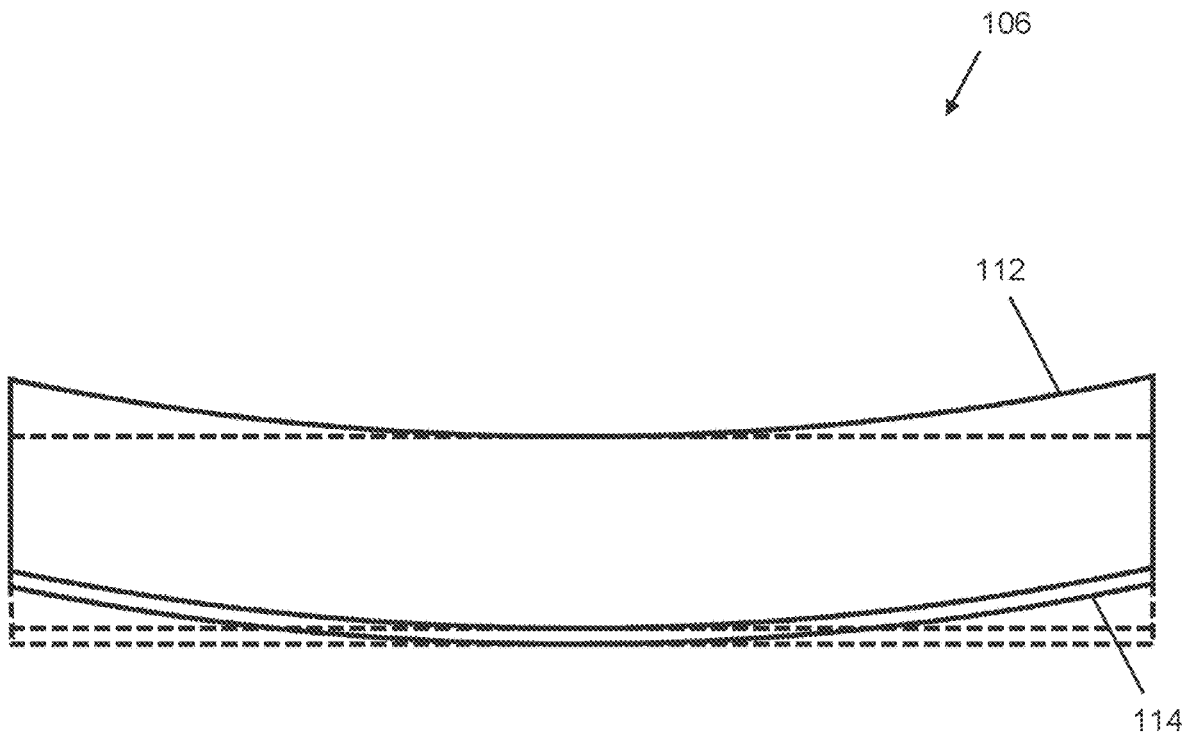
FIG. 9 is a side view of the first alternative beam.

FIG. 9 shows a first alternative beam 106 resulting from such a distortion process. A beam which does not under welding distortion is shown in phantom, for comparison. As the stub 128 cools during and after welding, it contracts due to the effects of thermal expansion. This causes the flange 114 to curve along its longitudinal axis (i.e. to form an approximately U-shape from the perspective shown in FIG. 9). The cooling of the additional weld material 130 and contraction thereof may further cause the flange 114 to curve about its longitudinal axis (i.e. to form an approximately U-shape from the perspective shown in FIG. 8).

Figure 10:
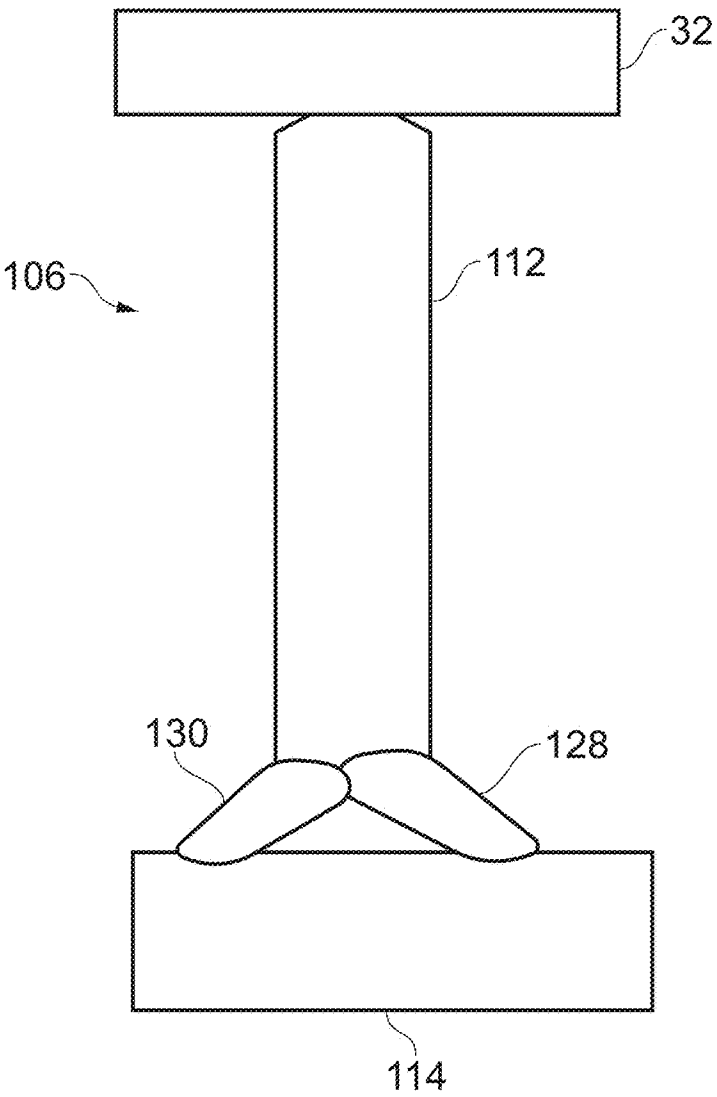
FIG. 10 is a cross-sectional view of the first alternative beam following a first process.

FIG. 10 shows a further stage of manufacture of the dome 2 in cross-section. The further stage comprises welding a plurality of plates 32 to the outwardly-facing webs 112. The plates 32 forms an exterior skin of the cylindrical structure 4 and occlude the gaps formed between the beams 106, thereby forming a sealed structure. The flanges 114 form a stiff web that supports the exterior skin. A plurality of plates are not welded to the inwardly facing webs or to the flange 114, and, thus, the flanges 114 and the exterior skin form open cells that open into an interior of the cylindrical structure 4. The webs 112 and the flanges 114 can be used to support one or more inspection devices such as automated roving inspection units that inspect an interior of the dome 2. The connections between the flanges 114 (i.e. the nodes) may act as anchors for local automation for fabrication, inspection, heat treatment and assembly, and also act as a special reference system.

Figure 11:
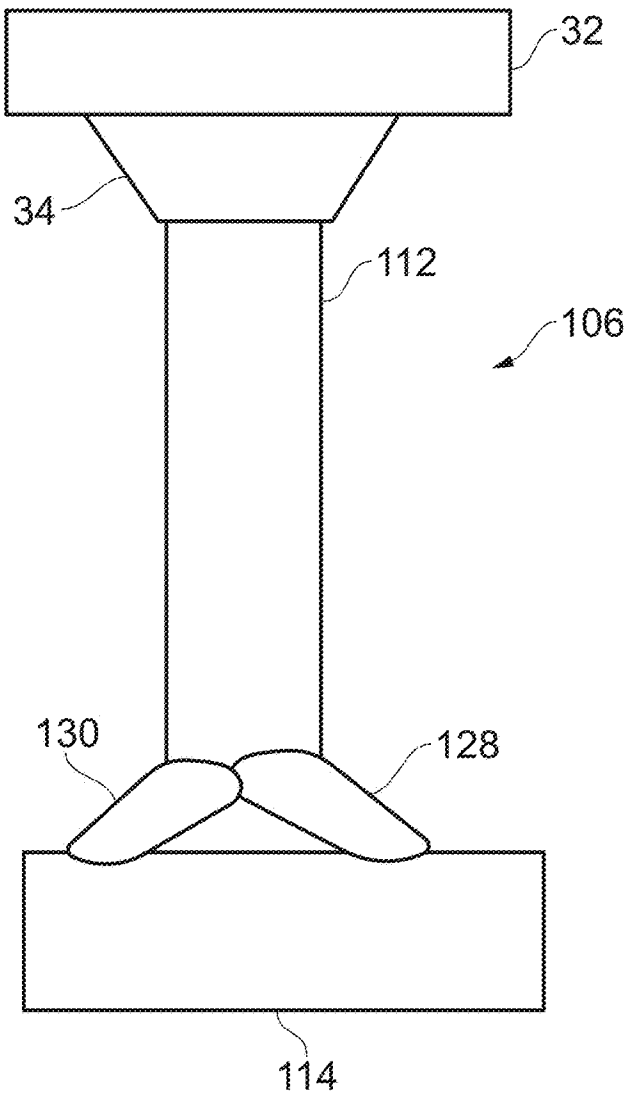
FIG. 11 is a cross-sectional view of the first alternative beam following an alternative process.

FIG. 11 shows an alternative further stage of manufacture of the dome 2. The alternative further stage comprises profiling the edge of the web 212 such that it is curved along its longitudinal axis. The profile may be achieved by building up a layer of weld material 34 of varying height along the length of the web 212. Alternatively, the profile may be achieved by upsetting or rolling.

Figure 12:
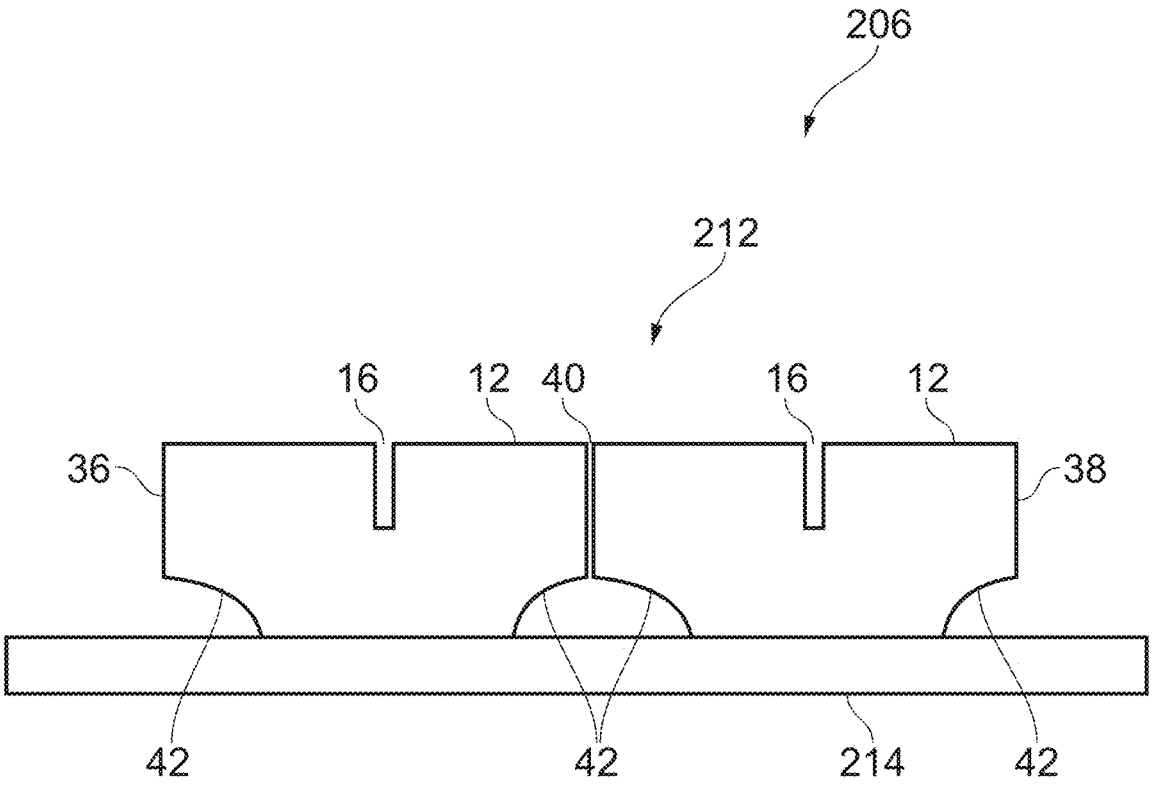
FIG. 12 is a side view of a second alternative beam.

FIG. 12 shows a second alternative beam 206. The second alternative beam 206 generally corresponds to the beams 6 described previously (i.e. the first beam 8 and the second beam 10) and features thereof are denoted using the same reference numerals with the addition of a value of 200. However, the web 212 is formed by multiple web sections 36, 38 that are each separated by a gap 40. The gap 40 allows the web 212 and the flange 214 to bend more easily to their desired shapes. Notches 42 or keyholes in the web sections 36, 38 also allow the web 212 and the flange 214 to bend more easily to their desired shapes, and simplify welding of the web sections 36, 38 to the flange 24.

Figure 13:
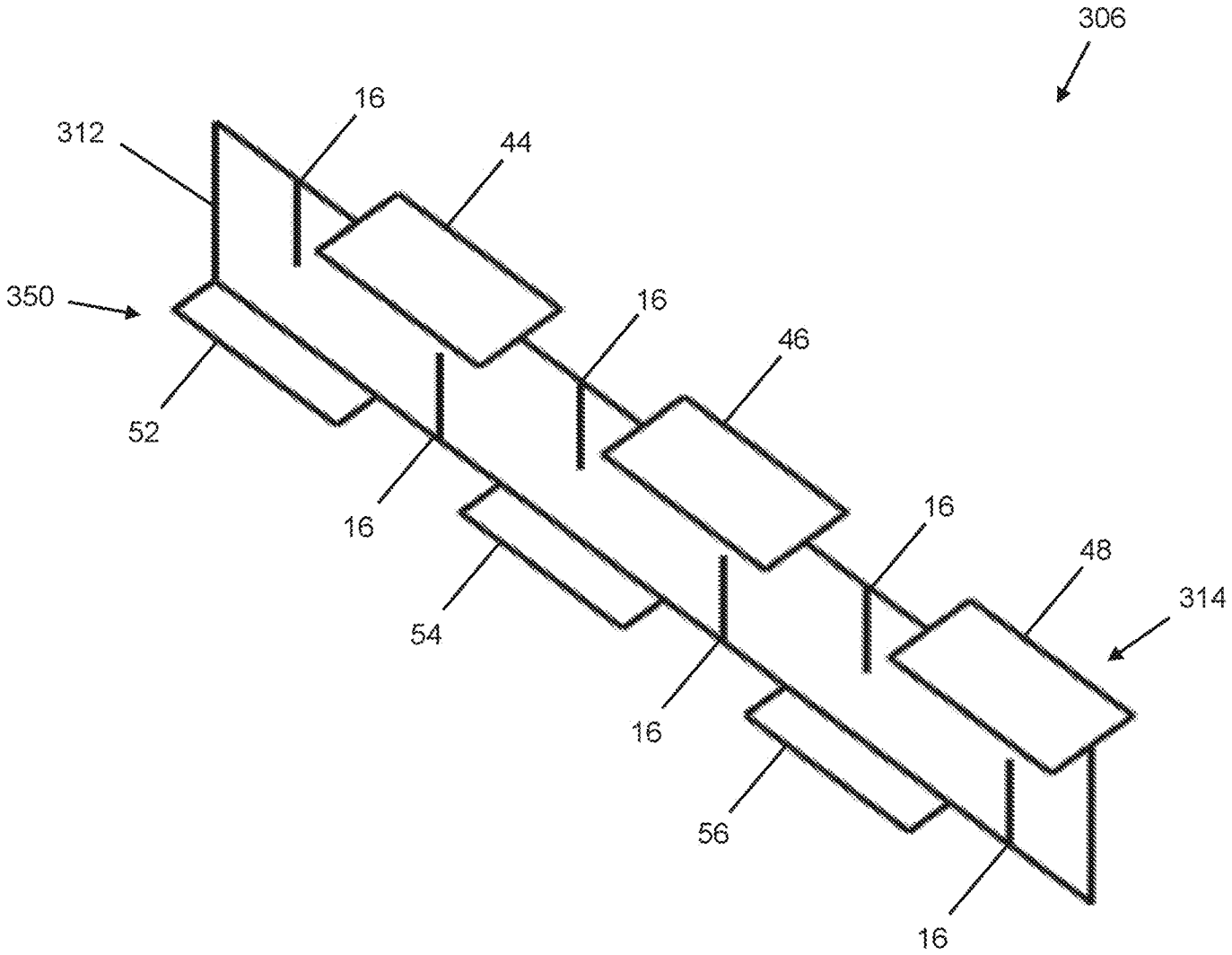
FIG. 13 is a perspective view of a third alternative beam.

FIG. 13 shows a third alternative beam 306. The third alternative beam 306 generally corresponds to the beams 6 described previously (i.e. the first beam 8 and the second beam 10) and features thereof are denoted using the same reference numerals with the addition of a value of 300. However, the slots 16 are formed on opposing and alternating sides of the web 312. A further flange 250 is provided on the opposing side of the web 312 to the flange 214. The flange 214 is formed by multiple flange sections 44, 46, 48 and the further flange 250 is formed by further multiple flange sections 52, 54, 56. The flange sections 44, 46, 48, 52, 54, 56 are spaced apart by gaps. The slots 16 are positioned within the gaps.

Figure 14:
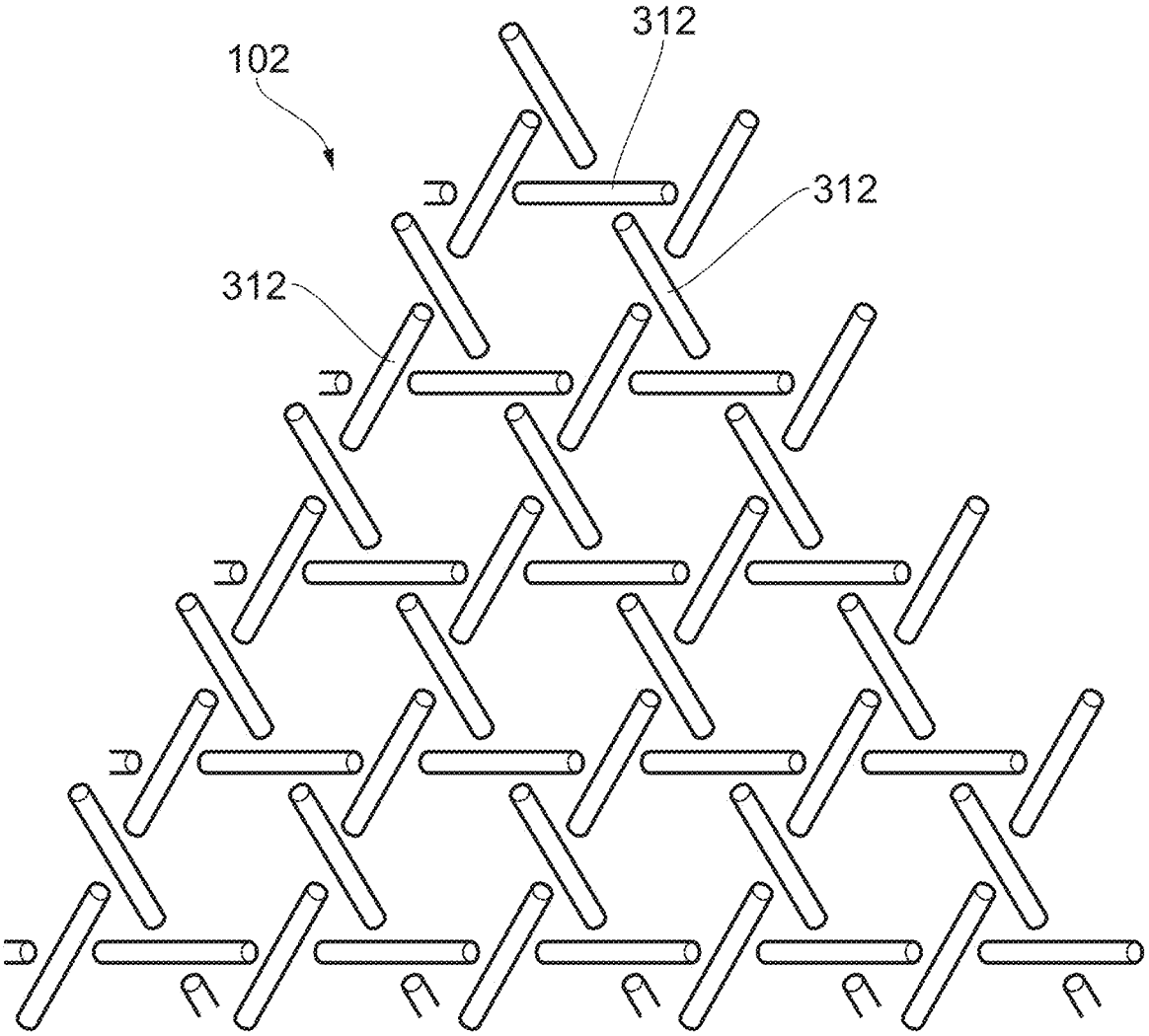
FIG. 14 is a plan view of a triangular lattice arrangement.

FIG. 14 shows a triangular lattice arrangement 102 formed by the third alternative beams 306. The triangular lattice arrangement 102 may be used instead of the hexagonal lattice arrangement 100 described with reference to FIG. 6. Only the webs 312 of the third alternative beams 306 are shown in FIG. 14, for clarity. As shown, each third alternative beam 306 alternates between passing over and under the other third alternative beams 306, and, as such, the alternating slots 16 on opposing sides of the web 312 can engage with the slots 16 of the other third alternative beams 306.

Figure 15:
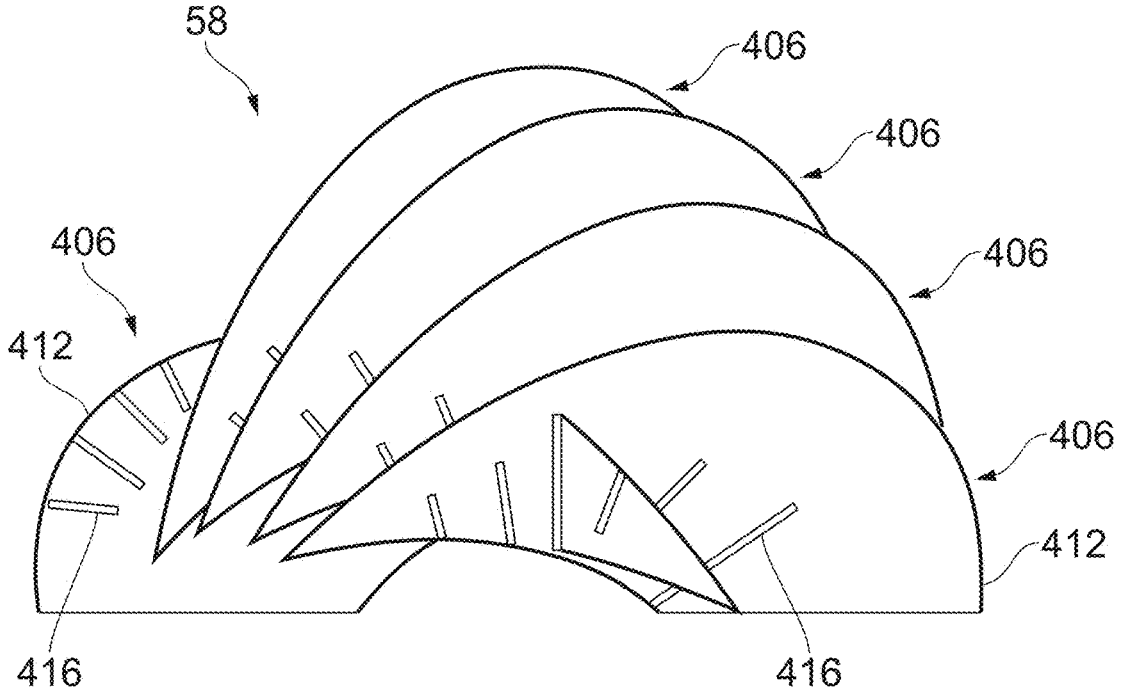
FIG. 15 is a perspective view of a dome formed by a plurality of fourth alternative beams.

FIG. 15 show a plurality of fourth alternative beams 406 engaged with each other in the manner described previously so as to form a dome 58. The fourth alternative beams 406 generally correspond to the beams 6 described previously (i.e. the first beam 8 and the second beam 10) and features thereof are denoted using the same reference numerals with the addition of a value of 400. The flanges of the fourth alternative beams 406 are not shown, for clarity. As shown, the webs 312 of the fourth alternative beams 406 are crescent-shaped.

Figure 16:
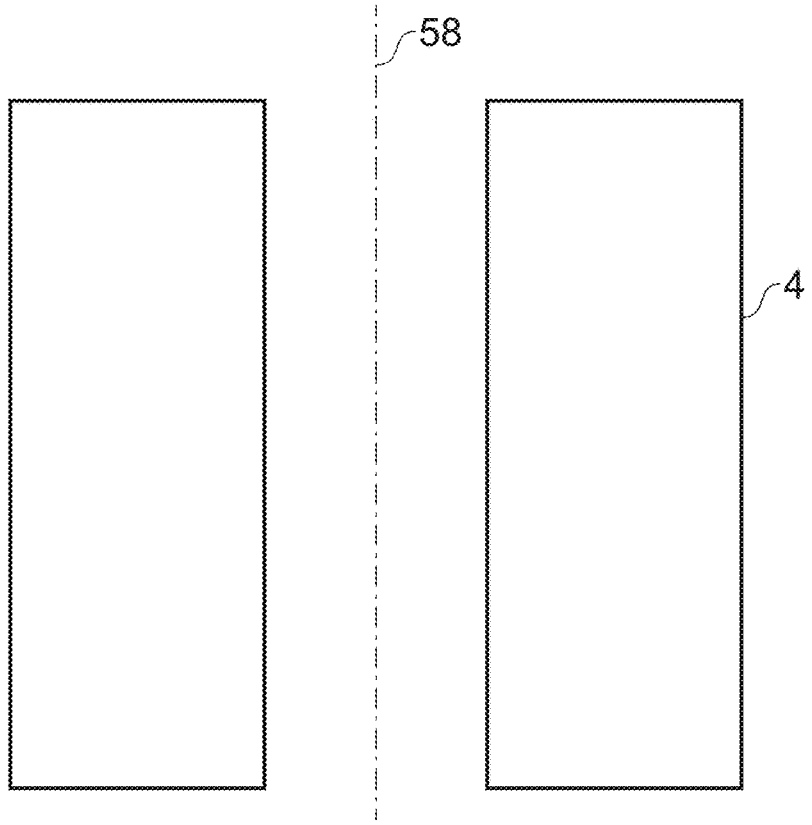
FIG. 16 is a cross-sectional view of a tube of the dome.

FIG. 16 is a cross-sectional view of the cylindrical structure 4 in isolation. As shown, the cylindrical structure 4 extends around a vertical axis 58. The cylindrical structure 4 may be manufactured in a step preceding step A1.

Figure 17:
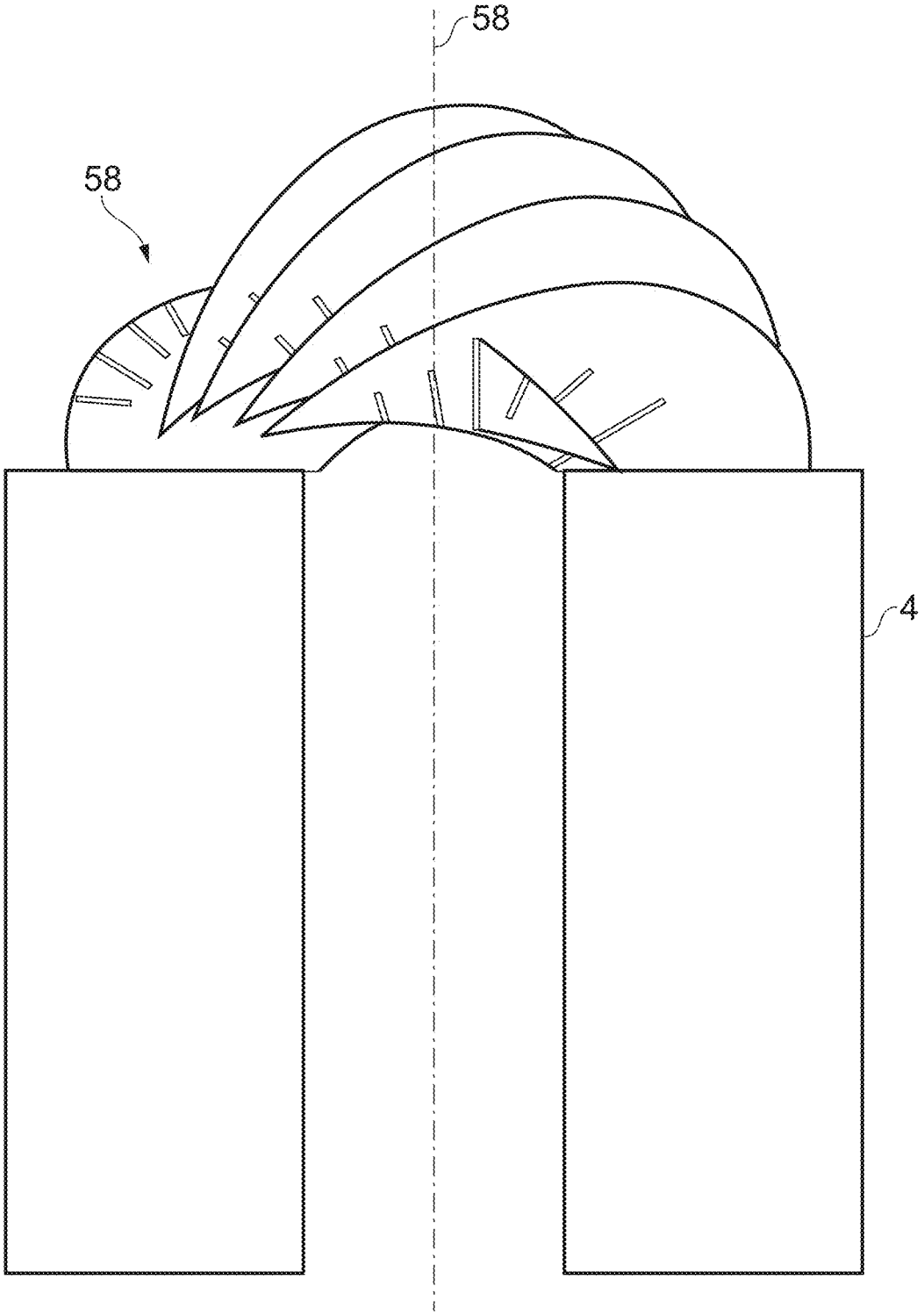
FIG. 17 is a cross-sectional view of the tube and the dome of the dome.

FIG. 17 is a cross-sectional view of the dome 58 following its manufacture on top of the cylindrical structure 4 in step A1 and step A2. As shown, the centre of the dome 58 is aligned with the vertical axis 58.

Figure 18:
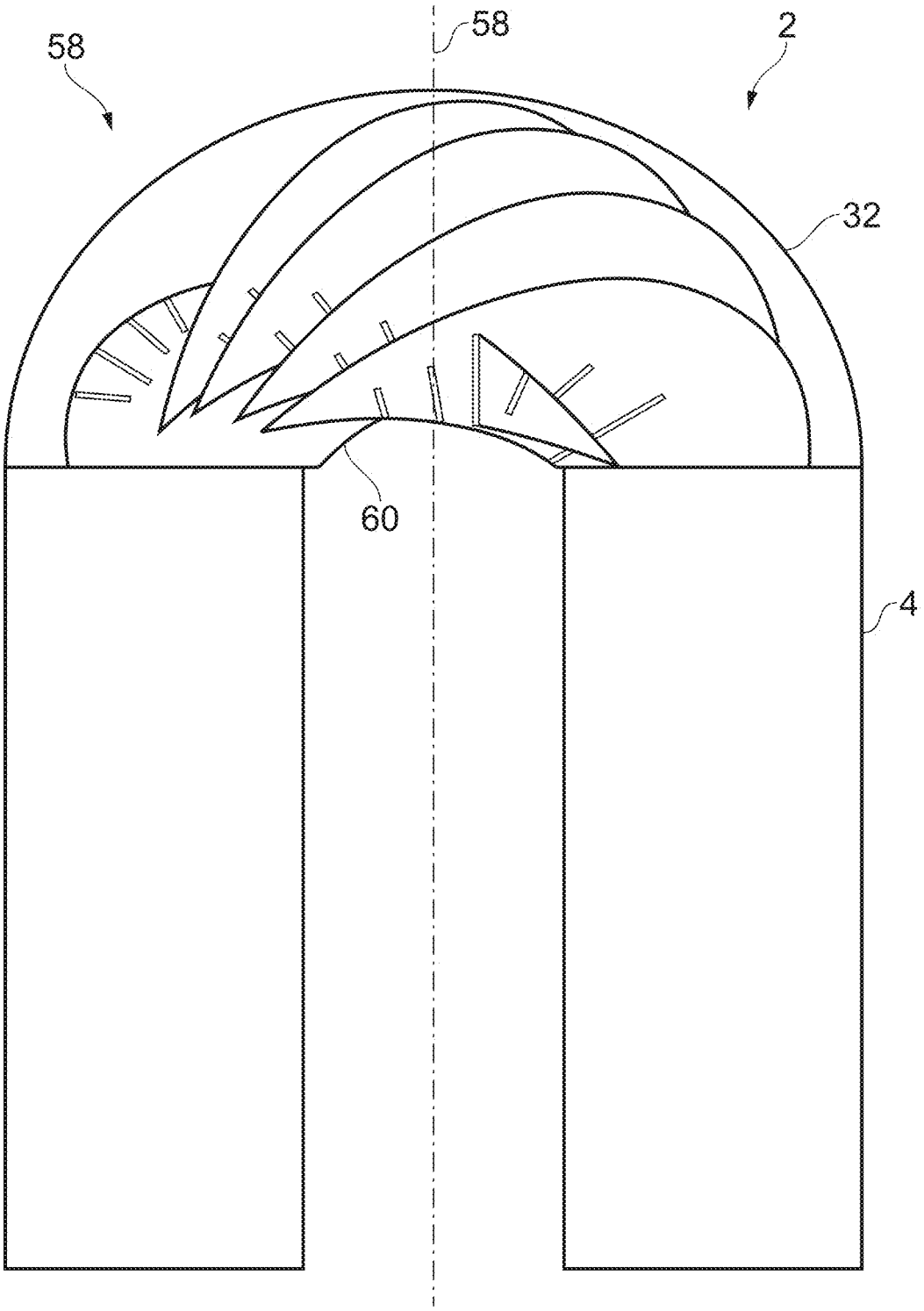
FIG. 18 is a cross-sectional view of the tube and the dome following the formation of an exterior skin and an interior skin of the dome.

FIG. 18 is a cross-sectional view of the cylindrical structure 4 and dome 58 following the formation of an exterior skin 32 and an interior skin 60 on the dome 58. The method of forming the exterior skin 32 on the dome 58 may correspond to that described previously. The method of forming the interior skin 60 on the dome 58 may substantially correspond to the method of forming the exterior skin 32 on the dome 58, however, instead of welding a plurality of plates 32 to the outwardly-facing webs 112, a plurality of plates 32 are welded to the inwardly-facing webs 112. The exterior skin 32, the interior skin 60 and the flanges 114 form closed cells. One or more of the closed cells may be partially or fully filled with a solid mass such as concrete so as to strengthen the dome 58. Additionally or alternatively, one or more of the closed cells may be partially or fully filled with insulating material so as to insulate the dome 58. The concrete or insulating material may be supplied to or injected into the closed cells via the through holes 26. The through holes 26 may allow for the release of gas displaced by the concrete or insulating material.

Figure 19:
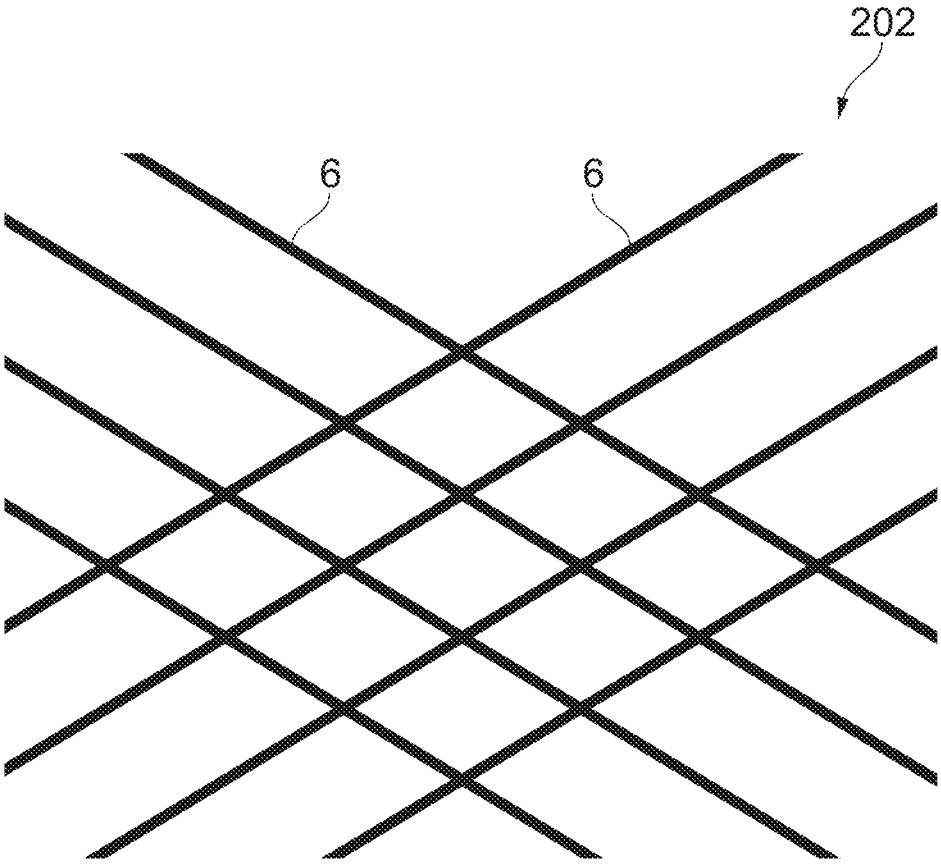
FIG. 19 shows a plan view of a rectangular lattice arrangement as configured in the dome.

FIG. 19 shows a plan view of a rectangular lattice arrangement 202 formed by the beams 6. The rectangular lattice arrangement 202 may alternatively be formed by the first alternative beams 106, the second alternative beams 206 or the third alternative beams 306. The rectangular lattice arrangement 202 may form the dome 2.

Figure 20:
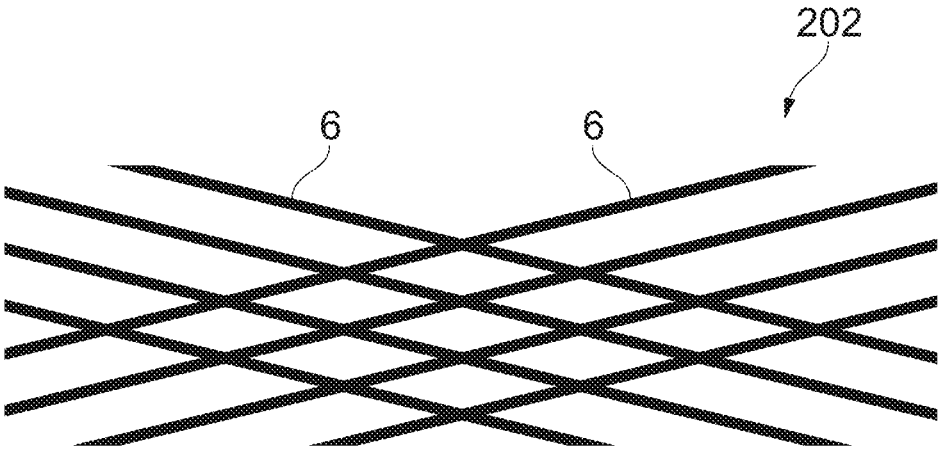
FIG. 20 shows a plan view of a rectangular lattice arrangement as configured for storage or transport.

FIG. 20 shows the rectangular lattice arrangement 202 of FIG. 19, prior to forming the dome 2. The beams 6 may be collapsed into the rectangular lattice arrangement 202 shown in FIG. 20 for ease of storage and transport and subsequently expanded into the rectangular lattice arrangement 202 shown in FIG. 19 when on-site.

The components described herein may be designed and manufactured using CAD and CAM. The components may be made of steel. The components may be manufactured using a water-jet cutting process Although it has been described that the beams of a dome are arranged in either a hexagonal lattice, a triangular lattice or a rectangular lattice, the beams of a dome may be arranged in any regular lattice arrangement. The beams of a dome may be arranged in multiple different types of lattice arrangements. By way of example, a first subset of the beams of a dome may be arranged in a hexagonal lattice, a second subset of the beams of a dome may be arranged in a triangular lattice and a third subset of the beams of a dome may be arranged in a rectangular lattice.

Although it has been described that the dome 2 is a dome for a power station reactor, it may be any suitable dome such as a dome for storing compressed gases, a heat reservoir, a bridge, a ship or an architectural fabrication. The dome may be used for storage of gases such as hydrogen. Gas storage may be carried out under normal operating conditions. Alternatively, the dome may store (i.e. contain) gases that have leaked from a structure contained within the dome.

The invention claimed is:

1. A dome, comprising:

a plurality of beams, each of the plurality of beams comprising one or more slots; and at least one of the slots of each of the plurality of beams is engaged with a slot of the one or more slots of another of the plurality of beams so as to form at least part of the dome, wherein at least a substantial portion of each of the plurality of beams being T-shaped comprising a web and a flange, and wherein the one or more slots are located in opposing sides of the webs.

2. The dome of claim 1, wherein at least one of the webs comprises a plurality of web sections, wherein each web section is separated from an adjacent said web section by a gap.

3. The dome of claim 1, wherein at least one of the flanges comprises a plurality of flange sections each separated by a first gap, and wherein each of the plurality of beams comprises a further flange disposed on a respective said opposing side of a respective said web to a respective said flange, the further flange comprising a plurality of further flange sections each separated by a second gap.

4. A method of manufacturing a dome, the method comprising:

providing a plurality of beams, each of the plurality of beams comprising one or more slots; and engaging at least one of the slots of each of the plurality of beams with a slot of the one or more slots of another of the plurality of beams so as to form at least part of the dome;

wherein at least a substantial portion of each of the plurality of beams being T-shaped comprising a web and a flange, and wherein the one or more slots are located in opposing sides of the webs.

5. The method of claim 4, wherein at least one of the webs comprises a plurality of web sections, wherein each web section is separated from an adjacent said web section by a gap.

6. The method of claim 4, wherein at least one of the flanges comprises a plurality of flange sections each separated by a first gap, and wherein each of the plurality of beams comprises a further flange disposed on a respective said opposing side of a respective said web to a respective said flange, the further flange comprising a plurality of further flange sections each separated by a second gap.

7. The method of claim 4, wherein a lower portion of the dome comprises a hollow cylindrical structure formed by a plurality of blocks or plates.

8. The method of claim 4, wherein at least a subset of the plurality of beams are arranged in a triangular lattice so as to form at least part of a geodesic dome.

9. The method of claim 4, wherein at least a subset of the plurality of beams are arranged in a rectangular lattice.

10. The method of claim 4, wherein at least a subset of the plurality of beams are arranged in a hexagonal lattice.

* * * * *